US010786725B2

(12) United States Patent
Puget et al.

(10) Patent No.: US 10,786,725 B2
(45) Date of Patent: Sep. 29, 2020

(54) ANALYSIS SYSTEM AND ASSOCIATED SLIDING BOARD

(71) Applicants: Skis Rossignol, Saint-Jean de Moirans (FR); Commissariat a l'Energie Atomique et aux Energies Alternatives, Paris (FR)

(72) Inventors: Nicolas Puget, Novalaise (FR); Johan Vailli, Coublevie (FR); Pierre Gasnier, Grenoble (FR); Sébastien Brulais, Grenoble (FR); Prince Arnaud Ramahefa-Andry, Grenoble (FR); Jean-Philippe Gros, Grenoble (FR)

(73) Assignees: Skis Rossignol (FR); Commissariat a l'Energie Atomique et aux Energies (FR)

( * ) Notice: Subject to any disclaimer, the term of this patent is extended or adjusted under 35 U.S.C. 154(b) by 0 days.

(21) Appl. No.: 16/244,367

(22) Filed: Jan. 10, 2019

(65) Prior Publication Data

US 2019/0224562 A1 Jul. 25, 2019

(30) Foreign Application Priority Data

Jan. 19, 2018 (FR) ..... 18 50426

(51) Int. Cl.
*A63C 11/00* (2006.01)
*A63C 5/06* (2006.01)

(52) U.S. Cl.
CPC ..... *A63C 11/003* (2013.01); *A63C 5/06* (2013.01); *A63C 2203/12* (2013.01); *A63C 2203/18* (2013.01); *A63C 2203/22* (2013.01); *A63C 2203/24* (2013.01)

(58) Field of Classification Search
CPC ..... A63C 11/003; A63C 5/075; A63C 5/06
See application file for complete search history.

(56) References Cited

U.S. PATENT DOCUMENTS 4,653,106 A * 3/1987 Yamatsuta ..... G01B 11/024 348/86
4,706,985 A * 11/1987 Meatto ..... A63C 5/126 280/610
5,590,908 A 1/1997 Carr
5,775,715 A * 7/1998 Vandergrift ..... A63C 9/00 280/602
5,826,909 A * 10/1998 Brommer ..... A63C 5/06 280/602
5,860,861 A * 1/1999 Lipps ..... A63F 13/06 463/36

(Continued)

FOREIGN PATENT DOCUMENTS

WO WO9704841 A1 2/1997
WO WO2011160040 A2 12/2011

*Primary Examiner* — Hau V Phan
(74) *Attorney, Agent, or Firm* — Forge IP, PLLC

(57) ABSTRACT

A system for analysis of use of a sliding board comprising at least one piezoelectric element configured to be secured to the sliding board and generate electric energy during deformations of the sliding board; and an electronic processing circuit configured for estimating at least one parameter of use of the sliding board and configured to be connected to the sliding board. The electronic processing circuit is powered by the electric energy generated by the at least one piezoelectric element.

17 Claims, 7 Drawing Sheets

(56) References Cited

U.S. PATENT DOCUMENTS

| | | | | | |
|---|---|---|---|---|---|
| 5,869,189 | A * | 2/1999 | Hagood, IV | H01L 41/082 | 310/357 |
| 6,086,490 | A * | 7/2000 | Spangler | A63B 60/00 | 473/564 |
| 6,095,547 | A * | 8/2000 | Vandergrift | A63C 9/00 | 280/602 |
| 6,102,426 | A * | 8/2000 | Lazarus | A63B 60/54 | 280/602 |
| 6,196,935 | B1 * | 3/2001 | Spangler | A63B 53/00 | 473/318 |
| 6,230,501 | B1 * | 5/2001 | Bailey, Sr. | A43B 1/0054 | 62/51.1 |
| 7,080,849 | B2 * | 7/2006 | Lammer | A63C 5/075 | 280/602 |
| 7,107,706 | B1 * | 9/2006 | Bailey, Sr. | A43B 3/0005 | 36/29 |
| 7,160,286 | B2 * | 1/2007 | Lammer | A63B 49/02 | 606/1 |
| 7,219,449 | B1 * | 5/2007 | Hoffberg | A43B 1/0054 | 36/29 |
| 8,929,085 | B2 * | 1/2015 | Franklin | G06F 1/1626 | 361/749 |
| 9,305,120 | B2 * | 4/2016 | Failing | G06F 30/00 | |
| 2005/0192129 | A1 * | 9/2005 | Kuwabara | A63B 43/06 | 473/520 |
| 2012/0227285 | A1 * | 9/2012 | Adair | A43B 13/14 | 36/115 |
| 2014/0295757 | A1 * | 10/2014 | Kubota | G01P 1/127 | 455/41.1 |

* cited by examiner

D
t

Vcs
ΔV2
P
ΔV1
ΔV3
REFmax
REFmin
S1h
S1b t
M
10
5
1 t
T
T1 t
T
T1 tRefmin
t
P1
P2
P3
P4

D
t

Vcs
REFmax
REFmin
S1h
S1b
S0h
S0b
ΔV2
P
ΔV1
ΔV3
ΔV4
t

M
M1
5
1
t

T
T2 t
P1a
T
T2 tRefmin
t
P1
P2
P3
P4

ANALYSIS SYSTEM AND ASSOCIATED SLIDING BOARD

TECHNICAL FIELD

The invention relates to the domain of boards for sliding on snow or on water, and in particular downhill, cross-country or touring skis, or even snowboards and wakeboards.

More specifically the invention relates to a system for analysis of the use of a sliding board, meaning an electronic circuit with which to obtain at least one item of information related to the use of the sliding board. The invention also relates to a sliding board instrumented and/or equipped with this analysis system.

PRIOR ART

From the U.S. Pat. No. 5,590,908 it is known to measure the deformation of a sliding board by means of a piezoelectric sensor in order to get information on the points of contact of the sliding board with the snow. From the patent EP 0,841,969 it is also known to use piezoelectric sensors for damping vibrations of a sliding board.

This type of sensor uses the intrinsic behavior of a piezoelectric element which converts mechanical energy of deformation into electrical energy.

To analyze the deformation of a sliding board using a piezoelectric sensor, it is necessary to use a continuously powered electronic analysis circuit. Thus, it is necessary to use an electrical energy source providing a constant voltage, such as an electrochemical battery or any other known means.

However, an electrochemical battery has constraints on size and weight, cold resistance and storage, which are not generally compatible with a sliding board. In fact, a sliding board on snow can be used at temperatures near −20° C. In this operating temperature range, conventional electrochemical batteries perform poorly or are even unusable. Further, batteries discharge quickly in the cold and batteries must be replaced or recharged by the user often, which is very constraining. Further, a sliding board on snow is often used occasionally, for example a few days each winter.

An electrochemical battery installed on a sliding board on snow would therefore have long periods of inactivity, at least between the spring and the fall, during which the electrochemical battery would be completely discharged. Further, a sliding board is a mechanical element undergoing significant stresses, such as torsion or impact.

The concrete applications involving the use of an electronic circuit and piezoelectric element installed on a sliding board are therefore limited and the large majority of measuring devices existing in other fields of application are not transposable on a sliding board because of these specific constraints.

The document WO 2011/160040 describes a skateboard deck with electroluminescent diodes disposed on the board for displaying light effects on the ground. The supply for the diodes is normally done by a battery but an embodiment proposes using a piezoelectric transducer for powering these electroluminescent diodes. Other than this display device, this document also proposes incorporating an electronic circuit on the skateboard deck in order to make measurements over time. This electronic circuit is powered by a battery and can incorporate a movement sensor such as previously described, meaning a piezoelectric sensor using a deformation measurement coming from a piezoelectric element.

However, the teaching from that document is not suited to the domain of boards for sliding corresponding to the invention, meaning boards for sliding on snow or on water, and in particular downhill, cross-country or touring skis, or even snowboards and wakeboards. In fact, for sliding boards, the lower surface of the sliding boards is intended to come in contact with the surface on which the board progresses, unlike a skateboard. It is therefore not useful to place luminescent elements on the sliding board from the invention because these elements would not be visible. Further, this document only describes a conventional method for supplying the electronic circuit doing the measurements, meaning the use of a battery.

The technical problem that the invention proposes to resolve is therefore to find how to obtain information related to the use of a sliding board, such as the length of use of the sliding board, the number of stresses of the sliding board, even the power exerted by the user on the sliding board, while also freeing it from a supplemental power supply source, and in particular an electrochemical battery.

DISCLOSURE OF THE INVENTION

The invention proposes to address this technical problem by using at least one piezoelectric element secured to a sliding board and by using this piezoelectric element for powering an electronic processing circuit. The electronic processing circuit includes elements determining parameters related to the use of the sliding board, such as the length of use and/or the number of stresses on the sliding board. Said at least one piezoelectric element and the associated electronic processing circuit together form an autonomous electronic circuit.

For this purpose, according to a first aspect, the invention relates to a system for analysis of the use of a sliding board comprising:

- at least one piezoelectric element intended to be secured to said sliding board and intended to generate electric energy during deformations of said sliding board; and
- an electronic processing circuit configured for estimating at least one parameter of use of said sliding board and intended to be connected to said sliding board.

The invention is characterized in that said electronic processing circuit is powered by said electric energy generated by said at least one piezoelectric element.

With the invention, parameters related to the use of the sliding board can thus be obtained by using only the energy produced by said at least one piezoelectric element. By doing that, parameters related to the use of the sliding board can be obtained with the invention without using a supplemental energy source, meaning without using an electrochemical battery, whether rechargeable or not, or any other known energy source, for example solar panels. Thus, an electronic circuit very resistant to climatic conditions and periods of inactivity can be obtained with the invention.

Preferably, the estimation of the at least one usage parameter of said sliding board done by said electronic processing circuit is determined depending on said electrical energy generated by said at least one piezoelectric element.

According to an embodiment, said electronic processing circuit comprises at least one capacitive storage element intended to store at least a portion of said electric energy generated by said at least one piezoelectric element.

The energy produced by the at least one piezoelectric element and which would not be used by the electronic circuit can be stored by this capacitive storage element. By returning this energy little by little over time for supplying the electronic processing circuit in the phases during which the at least one piezoelectric element does not produce sufficient energy for supplying the electric processing circuit, the capacitive storage element integrates all the energy produced by said at least one piezoelectric element.

According to an embodiment, said electronic processing circuit is configured for estimating a length of use of the sliding board and/or for estimating an image of the mechanical energy imposed on the sliding board.

According to an embodiment, said electronic processing circuit comprises a management member configured for incrementing at least one binary count when the voltage at the terminals of said capacitive storage element reaches a threshold value or a maximum reference value such that said at least one binary count represents the length of use of the sliding board and/or an image of the mechanical energy imposed on the sliding board. This binary count is not a direct measure of the deformations the surface of the sliding board, the information obtained by this binary count is for example related to the deformation time of the sliding board—in this scenario the binary count is called time count—or related to the amplitude of the deformations of the sliding board—in this case the binary count is called activation count.

Thus, this binary count can also be used to estimate the time and/or intensity of the stresses, the actual length of use of the sliding board, and even the wear of this sliding board or the level of engagement of a skier on one or the other of the skis thereof.

According to an embodiment, the electronic processing circuit comprises a nonvolatile memory connected to said management member, where said management member is configured for writing said at least one binary count into memory. In this embodiment, the time count and/or the activation count can be recorded and these counts can be stored in memory when the electronic circuit is not powered.

According to an embodiment, said management member is configured for writing the time count in said nonvolatile memory when a minimum reference value internal to the management member is reached.

According to an embodiment, said management member is configured for writing the activation count in said nonvolatile memory when a maximum reference value internal to the management member is reached. This maximum reference value is set beyond the minimum operating voltage of the electronic processing circuit.

Information related to the amplitude of the deformations of the surface on which the at least one piezoelectric element is placed can be obtained from the activation count.

By using the time count and the activation count over a single recording length, it is possible to determine information related to the power experienced by the sliding board by dividing the activation count by the time count.

By doing this, this information related to the power experienced by the sliding board can be used to estimate the wear on the sliding board or the engagement of the user over the recording time.

According to an embodiment, said management member comprises an internal clock, where said management member is configured for incrementing a time count for each period of said internal clock as soon as the management member is powered. Information related to the time of deformation of the surface on which the at least one piezoelectric element is placed can be obtained with this time count. By using the internal clock of the management member, the generation of this time count consumes very little energy.

According to one embodiment, said electronic circuit comprises:

an oscillator intended to produce a periodic signal; and a counter connected to said oscillator, configured to increment said at least one binary count representing the length of use of the sliding board, referred to as time count, at each period of the periodic signal produced by said oscillator;

where said time count is accessible to the management member.

By using very simple and low energy consumption electronics, specifically an oscillator and a counter, a time count can be obtained for this embodiment.

For example, the oscillator can be a quartz oscillator and the counter can be implemented by placing a series of T flip-flops in cascade.

According to an embodiment, said electronic processing circuit comprises at least one comparator with hysteresis configured for comparing the voltage at the terminals of said capacitive storage element with at least two threshold values.

The comparator with hysteresis is configured for allowing or preventing powering up of the management member depending respectively on a first and a second threshold value.

According to an embodiment, the electronic processing circuit comprises a second comparator with hysteresis configured for allowing or preventing powering up of the oscillator and counter depending respectively on a third and a fourth threshold value.

According to an embodiment, said electronic processing circuit comprises a radio frequency antenna configured for powering said nonvolatile memory by electromagnetic coupling such that an external reader can obtain, wirelessly, said at least one binary count.

The supply of an autonomous electronic circuit by electromagnetic coupling is preferably done by radio frequency identification technology, better known as RFID, for "Radio Frequency Identification."

In this embodiment, the memory of the electronic circuit can be easily read for obtaining the binary counts without using a physical connection with the electronic circuit.

This external reader can correspond to a specific reader, a smart phone or even a computer.

According to an embodiment, said electronic processing circuit comprises a voltage converter placed at the output of the at least one piezoelectric element, where said voltage converter is intended to provide a rectified or direct voltage from the voltage generated by the at least one piezoelectric element.

According to a second aspect, the invention relates to a method for analysis of the use of a sliding board implemented by the system such as defined according to the first aspect of the invention.

This method is characterized in that depending on the voltage at the terminals of said capacitive storage element, said management member is configured for writing said time count and/or said activation count in the nonvolatile memory.

According to a third aspect of the invention, the invention relates to a sliding board comprising a system for analysis of a use of said sliding board according to the first aspect of the invention.

An instrumented sliding board can be obtained with this third aspect of the invention, meaning integrating an electronic circuit with which to obtain information related to the use and/or deformation of the sliding board.

According to an implementation, said electronic circuit is mounted on said at least one piezoelectric element. In this embodiment, a single case can thus be used reducing the size on the sliding board. Preferably, the case for the electronic circuit has a flexion capacity substantially equivalent to that of the at least one piezoelectric element so as to limit the impact of the presence of the case on the flexion capacities of the at least one piezoelectric element. Typically, the case can be made of a plastic whose hardness is included between 50 and 100 Shore A.

According to an embodiment, said sliding board comprises binding elements mounted between a front end and a rear end of said sliding board, where said at least one piezoelectric element is arranged between said binding elements and said front end of said sliding board.

In this embodiment, deformations of the sliding board can be effectively captured in a region where the deformations have large amplitudes.

Preferably, the at least one piezoelectric element is arranged right in front of the binding because this area is less exposed impacts, in particular impacts due to the crossing skis.

According to an embodiment, said sliding board comprises several structural layers:

- a lower assembly comprising at least one bottom intended to come into contact with a sliding surface and at least one reinforcing layer;
- an upper assembly comprising at least one reinforcing layer; and
- a core interposed between the upper and lower assemblies;

where said at least one piezoelectric element is disposed in contact with at least one reinforcing layer.

In this embodiment, deformations of the structural element which give the sliding board the properties of stiffness thereof can effectively be captured. The upper assembly can also comprise a protective and decorative layer which is conventionally less stiff than the reinforcing layer.

The deformations of the reinforcing layer are therefore dampened by the protective and decorative layer.

Thus, with the preferential position of the at least one piezoelectric element on the reinforcing layer, an undamped and more relevant recording of the deformations of the sliding board can be obtained.

According to an embodiment, where said upper assembly comprises a protective and/or decorative layer, said sliding board comprises an opening in said protective and decorative layer in which said at least one piezoelectric element is positioned.

In this embodiment, the reinforcing layer can be accessed from the upper surface of the sliding board so as to install and/or maintain the piezoelectric element.

According to an embodiment, said sliding board comprises a protective and/or decorative layer, where said at least one piezoelectric element is disposed in contact with this protective and/or decorative layer.

According to an embodiment, said electronic circuit is mounted on said sliding board in a protective case.

In this embodiment, the electronic circuit is protected from impact and moisture, for example from rain and snow.

According to an embodiment, said protective case is mounted removably on said sliding board.

In this embodiment, maintenance of the electronic circuit is easier. Further, in this embodiment, the electronic circuit can be moved for analyzing deformations of several sliding boards with a single electronic circuit.

According to an embodiment, said sliding board comprises at least one interface element between the upper surface of the sliding board and the binding elements, where said protective case is attached to said at least one interface element.

In this embodiment, the protective case can effectively be attached the sliding board by moving the protective case from the binding.

BRIEF DESCRIPTION OF THE FIGURES

The way to practice the invention, and also the advantages which followed there from, will emerge clearly from the description of the following embodiments, with the support of the attached figures in which:

FIGS. 3*a* to 3*e* are temporal representations of acquisition of various parameters done using the system from FIG. 1, in which: FIG. 3*a* shows deformations of the sliding board (D); FIG. 3*b* shows the voltage at the terminals of the capacitive storage element; FIG. 3*c* shows the data about the activation count recorded in nonvolatile memory; and FIGS. 3*d* and 3*e* show the data about the time count respectively in the microcontroller and in the nonvolatile memory;

FIGS. 4*a* to 4*e* are temporal representations of acquisition of various parameters done using the system from FIG. 2, in which: FIG. 4*a* shows deformations of the sliding board (D); FIG. 4*b* shows the voltage at the terminals of the capacitive storage element; FIG. 4*c* shows the data about the activation count recorded in nonvolatile memory; and FIGS. 4*d* and 4*e* show the data about the time count respectively in a buffer memory and in the nonvolatile memory;

Of course, the dimensions and proportions of some elements constituting the invention have been deformed, exaggerated and/or separated from reality for the purpose of making the invention well understood.

METHOD FOR IMPLEMENTING THE INVENTION

Figure 1:
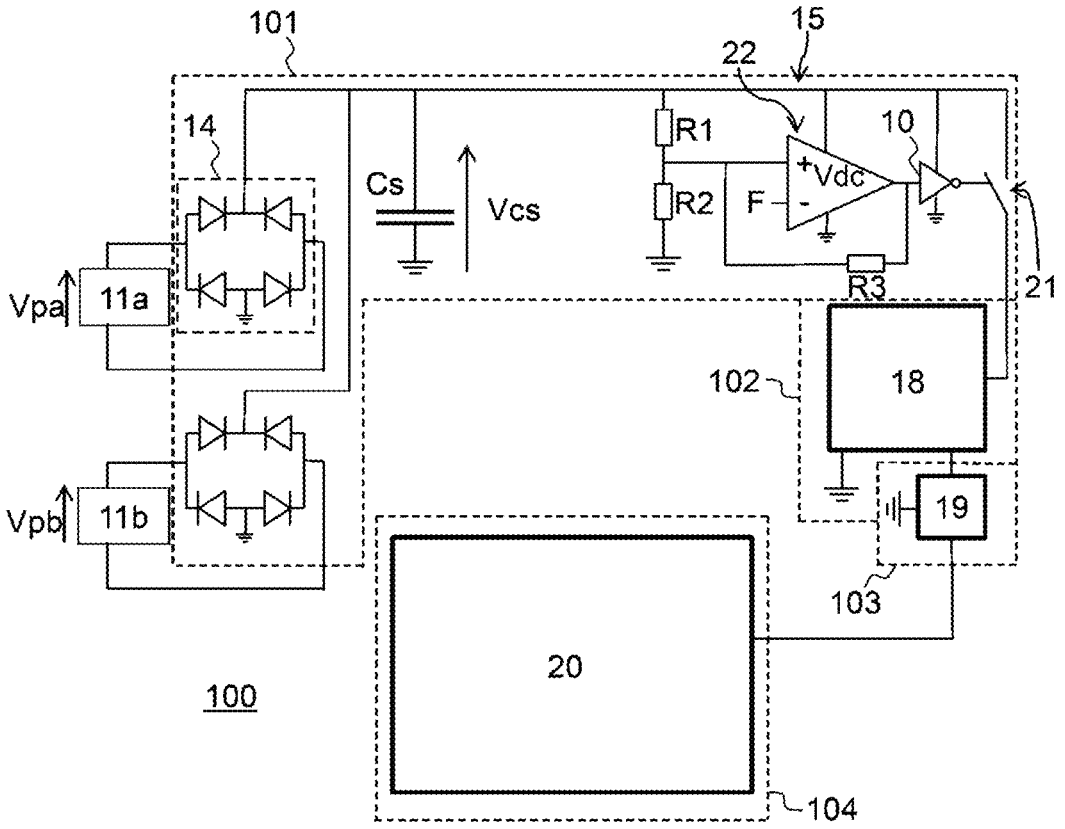
FIG. 1 is an electrical drawing of a system for analysis of the use of a sliding board according to a first embodiment of the invention.
Figure 2:
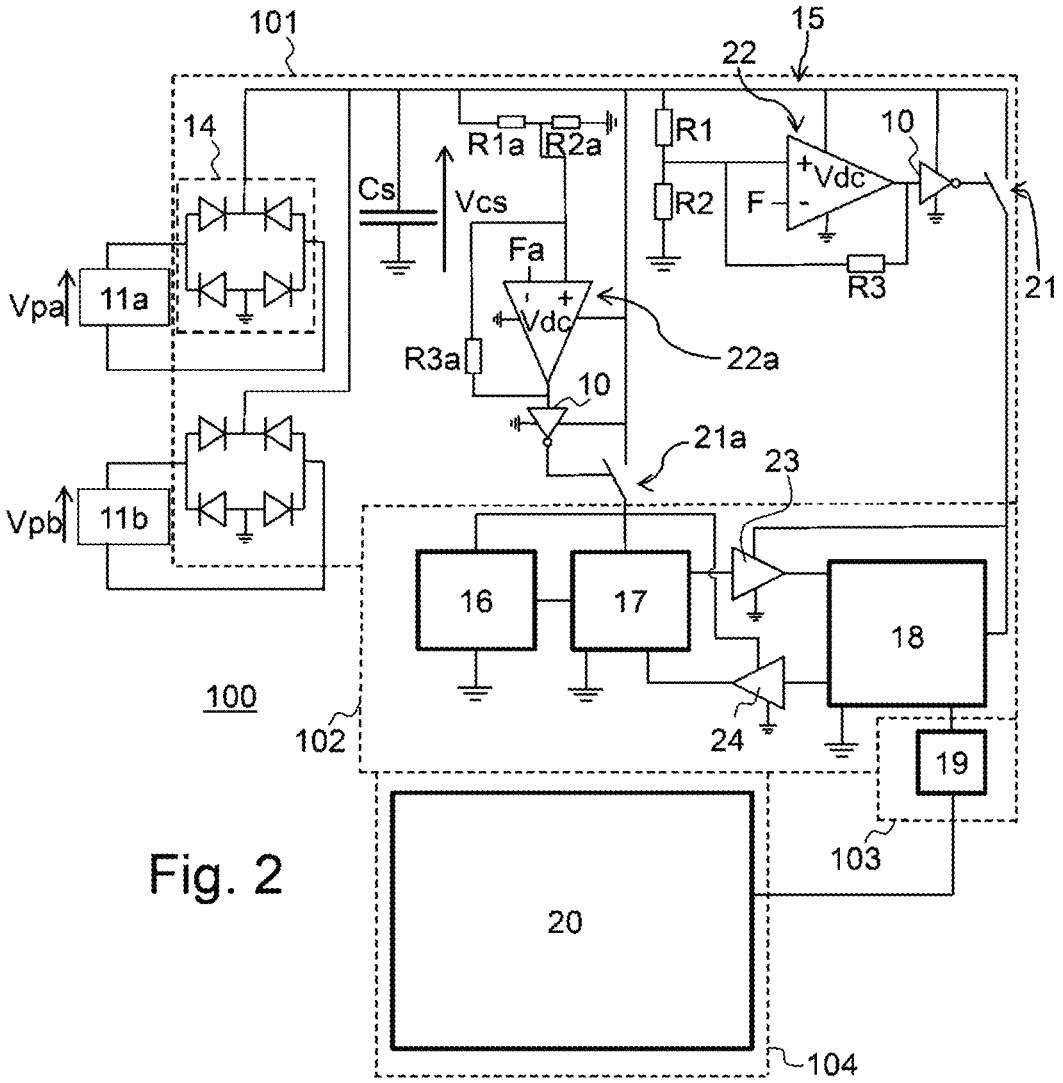
FIG. 2 is an electrical drawing of a system for analysis of the use of a sliding board according to a second embodiment of the invention.

FIGS. 1 and 2 show two embodiments of an electrical drawing of a system 100 for analysis of use of a sliding board 25. This analysis system 100 is intended to be secured to a sliding board 25 as will be shown in FIGS. 5 to 13.

According to these two embodiments, the analysis system 100 comprises both the at least one element intended to produce the electric energy following a deformation, such as a piezoelectric element 11*a*, 11*b*, and also an electronic processing circuit 15.

The electronic processing circuit 15 comprises a portion relating to the storage and management of electric energy 101, and also a portion 102 relating to the determination of the at least one information related to the use of the sliding board 25, where this portion 102 comprises elements providing estimates and calculations related to the use of the sliding board 25.

In order to store the information related to the use of the sliding board 25, the electronic processing circuit 15 further comprises a portion 103 relating to the storage of the data. And finally, in order to assure communication of these data to a device external to the analysis system 100, the electronic processing circuit 15 comprises a portion 104 relating to communication.

In a way common to the two embodiments, the system 100 comprises at least one piezoelectric element 11*a*, 11*b*; here there are two. The piezoelectric elements 11*a*, 11*b* are not directly connected to each other. The piezoelectric elements 11*a*, 11*b* can be arranged electrically in parallel. Alternatively, the piezoelectric elements 11*a*, 11*b* are arranged electrically in series with respect to each other.

Both piezoelectric elements 11*a*, 11*b* are intended to generate an electrical signal during use of the sliding board 25. More specifically, each piezoelectric element 11*a*, 11*b* generates a voltage Vpa, Vpb in response to a mechanical deformation that it experiences. In the presence of several piezoelectric elements 11*a*, 11*b* this voltage Vpa, Vpb can vary from one piezoelectric element 11*a*, 11*b* to the other.

The electronic processing circuit 15 is powered solely by piezoelectric elements 11*a*, 11*b*. Thus the analysis system 100, itself forming an electronic circuit composed of piezoelectric elements 11*a*, 11*b* and also an electronic processing circuit 15, is autonomous, meaning that it does not require a power source outside the analysis system 100, such as a rechargeable or ordinary battery. In other words, the piezoelectric elements 11*a*, 11*b* play both the role of information source for determining the use of the sliding board 25 and the role of electric power source, as will be described later.

The voltage Vpa, Vpb generated by each piezoelectric element 11*a*-11*b* is an alternating, not direct, current which has large variability in amplitude and frequency.

Figures 3A, 3B, 3C, 3D, 3E:
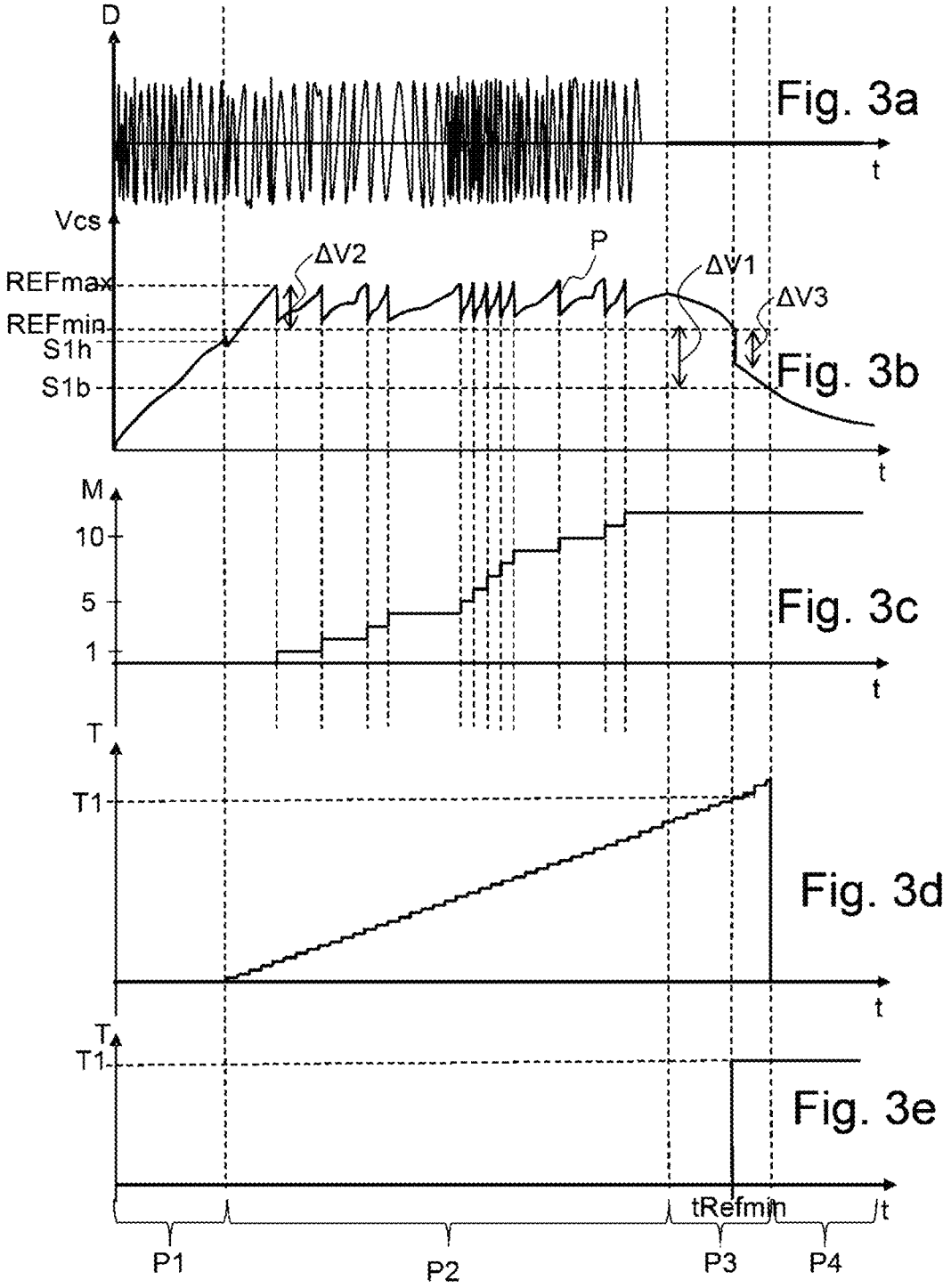
Figures 4A, 4B, 4C, 4D, 4E:
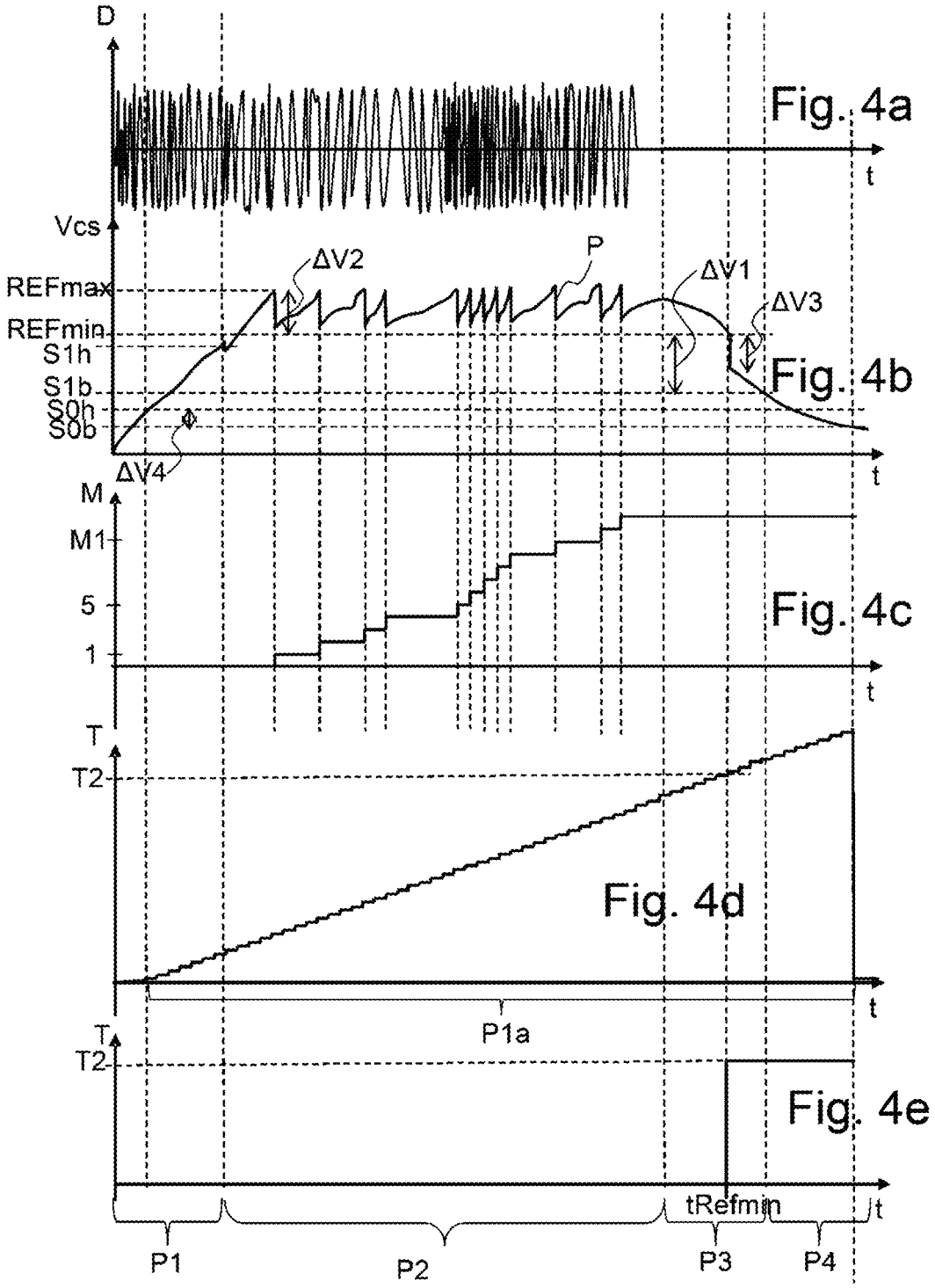

As shown by FIGS. 3*a* and 4*a*, during a phase P1, called start up, and during a phase P2, called writing, the sliding board 25 deforms in flexion when it is used and the surface 12 of the sliding board then experiences deformations transmitted to the piezoelectric elements 11*a*, 11*b* that generate a voltage Vpa, Vpb that varies depending on the deformations experienced by the surface 12. During a phase P3, called stoppage, and during a phase P4, called extinction, the sliding board 25 is stopped and, because of that, it is no longer deformed, also the surface 12 no longer experiences deformations and the voltage Vpa, Vpb generated by the piezoelectric elements 11*a*, 11*b* becomes zero.

In a way common to both embodiments, the portion relating to the storage and management of electric energy 101 comprises at least one voltage converter 14, at least one capacitive storage element Cs and at least one voltage comparator 22.

The voltage Vpa, Vpb, intrinsically variable, is injected into a voltage converter 14 which provides a rectified or direct voltage from the voltage Vpa, Vpb generated by each piezoelectric element 11*a*, 11*b*. According to both embodiments, this voltage converter 14 is made of a diode bridge which supplies the rectified voltage.

According to an implementation variant, the voltage converter 14 is made by a "buck" type, "boost" type or "buck-boost" type clipper; these clippers have the advantage of providing a direct voltage. It should be noted that each piezoelectric element 11*a*-11*b* is connected without intermediate element to the voltage converter 14. In the scenario where the piezoelectric elements 11*a*, 11*b* are arranged electrically in series or in parallel, it is advantageous to provide a single voltage converter 14, which can result in a non-negligible production savings.

At the output of the voltage converter 14, the voltage Vpa, Vpb generated by the piezoelectric elements 11*a*-11*b* is stored in a capacitive storage element Cs of super capacitor or condenser type. The capacitive storage element Cs can comprise several super capacitors or condensers without changing the invention. In the scenario where several condensers are used, they are disposed electrically in parallel with each other, with the sum of the capacitance of each condenser equal to the equivalent capacitance of the collection of condensers.

FIGS. 3*b* and 4*b* show the voltage Vcs at the terminals of the capacitive storage element Cs. In the initial state, meaning when the sliding board 25 is not used, the capacitive storage element Cs is completely discharged. In the starting P1 and writing P2 phases, the sliding board 25 is in use and deforms under flexion, in particular on snow. In the starting P1 and writing P2 phases, the deformations of the sliding board 25 and therefore the surface 12 charge the capacitive storage element Cs by means of the piezoelectric elements 11*a*, 11*b*.

Since the sliding board 25 is not stressed during the shutdown P3 and extinction P4 phases, the capacitive storage element Cs discharges.

The portion 101 relating to electric energy storage and management further comprises at least one voltage comparator 22, 22*a* configured for controlling the supply of power to the portion 102 relating to the determination of at least one information related to the use of the sliding board 25. To do that, the voltage comparator 22, 22*a* is configured for comparing the voltage Vcs at the output of the capacitive storage element Cs with two voltage thresholds S1*h*, S1*b*, S0*h*, S0*b*, as will be described later in connection with FIGS. 3*b* and 4*b*.

In a way common to both embodiments, the voltage comparator 22 is connected both to the capacitive storage element Cs by a supply terminal Vdc, to switch 21 on output, to one or more resistances R1, R2 and R3 on the positive terminal thereof and to a reference voltage F on the negative terminal thereof. Advantageously, a signal inverter 10 is arranged at the output of the voltage comparator 22. It should be noted that the switch 21 is, for example, a PMOS type transistor. Of course, this switch 21 can also be NMOS type transistor and, in that scenario, the architecture of the electronic processing circuit 15 would need to be adapted.

Further, the portion 103 relating to data storage comprises at least one nonvolatile memory 19, as will be described later. It should be noted that memory is called nonvolatile when the loss of power does not cause the loss of stored data.

As for the portion 104 relating to communication, it comprises an antenna 20, which will also be described later in the description.

According to the first embodiment shown in FIG. 1, the electronic processing circuit 15, and in particular the portion 102 thereof relating to the determination of at least one information related to the use of the sliding board 25, comprises a microcontroller 18.

The microcontroller 18 implements at least one binary count T, M and is configured for comparing the supply voltage thereof against at least one reference voltage value REFmax, REFmin. According to this embodiment, the microcontroller 18 implements two binary counts, one temporal binary count T corresponding to a length of use of the sliding board 25 and a binary count M called activation count, which is going to represent information related to the amplitude of the deformations of the sliding board 25.

In other words, according to this embodiment, the microcontroller 18 estimates both a length of use and an amplitude of deformations of the sliding board 25.

It should be noted that according to this embodiment, a single voltage comparator 22 is provided. This voltage comparator 22 implements the comparator function with hysteresis with which to close or open the switch 21 in order to connect, respectively disconnect, the microcontroller 18 from the capacitive storage element Cs. To do that, two thresholds are defined S1*h* and S1*b*, respectively called in the remainder of the description supply threshold S1*h* and cutoff threshold S1*b*. In other words, this voltage comparator 22 is configured for controlling the supply of the microcontroller 18 depending on the supply threshold S1*h* and cutoff threshold S1*b*.

When the voltage Vcs at the terminals of the capacitive storage element Cs reaches the supply threshold S1*h*, the output of the voltage comparator 22 goes to the high state. This inverted signal controls the switch 21, which by closing, connects the capacitive storage element Cs to the microcontroller 18.

In FIG. 3*b*, after having reached the supply threshold S1*h*, the voltage Vcs drops slightly in response to powering the microcontroller 18.

At the end of the stresses on the sliding board 25 (phases P3, P4), a discharge of the capacitive storage element Cs appears because the piezoelectric elements 11*a*, 11*b* are no longer supplying the capacitive storage element Cs. Because of the positive feedback of the resistances R1, R2 and R3 on the voltage comparator 22, the cutoff threshold S1*b* is set at a voltage value equal to S1*b*=S1*h*−ΔV1 where ΔV1 represents the hysteresis generated by placing the resistances R1 and R3 in parallel.

Thus, when the voltage Vcs at the terminals of the capacitive storage element Cs goes below the cutoff threshold S1*b*, the output of the voltage comparator 22 goes back to the low state, allowing the opening of the switch 21 and disconnecting the capacitive storage element Cs from the microcontroller 18.

In the remainder, the operating method for the portion 102 relating to the determination of at least one information related to the use of the sliding board 25 will be described according to the first embodiment from FIGS. 3*a*, 3*b*, 3*c*, 3*d* and 3*e*.

Once the microcontroller 18 is powered and the piezoelectric elements 11*a*, 11*b* continue to supply the capacitive storage element Cs (phase P2) with electric energy, the voltage Vcs then reaches a maximum reference value REFmax. When the voltage Vcs reaches maximum reference value REFmax, the microcontroller 18 is configured for incrementing the activation count M and writing it in nonvolatile memory 19, as shown in FIG. 3*c*. This incrementing and also this writing in memory of the activation count M consumes energy represented by a voltage drop ΔV2 in FIG. 3*b*.

According to this operating method, the activation count M, representing the mechanical energy imposed on the sliding board 25 is incremented by the value 1 each time the maximum reference value REFmax is reached by the voltage Vcs, as is shown by FIG. 3*c*. In other words, the activation count M counts the number of peaks P where the voltage Vcs reached the maximum reference value REFmax during the length of use of the sliding board 25.

The more these peaks P are packed together, the more the sliding board 25 is being stressed by the user; and the more the peaks P are separated, the less the sliding board 25 is being stressed by the user.

According to this embodiment, the time count T is determined by an internal clock of the microcontroller 18 which is activated when the microcontroller 18 is powered on, as shown in FIG. 3*d*. In other words, the time count T starts once the voltage Vcs reaches the supply threshold S1*h*.

When the flexions of the sliding board 25 are interrupted, the piezoelectric elements 11*a*, 11*b* stop supplying electric energy to the capacitive storage element Cs whose voltage Vcs progressively decreases and goes past a minimum reference value REFmin. According to the operating method, once the voltage Vcs reaches this minimum reference value REFmin, the microcontroller 18 is configured for writing the time count T in nonvolatile memory 19. It should be noted that writing this time count T leads to a voltage drop ΔV3.

In the first embodiment, the thresholds are defined such that:

$$S1b<S1h<REFmin<REFmax.$$

During the phases P2 and P3, the electronic processing circuit 15 performs at least one binary count T, M by using the voltage Vcs at the terminals of the capacitive storage element Cs.

During the phases P3 and P4, when the activity of the sliding board 25 is stopped, counting of the activation number M is automatically stopped since the maximum reference value REFmax is no longer reached, whereas the counting of the length of use T by the microcontroller 18 stops at the end of the phase P3, and at the beginning of phase P4 when the voltage V is less than or equal to the cutoff threshold S1*b* (FIG. 3*d*). However, according to this method of operation the counting of the length of use T by the microcontroller 18 after the time tREFmin is not recorded in the nonvolatile memory 19 (see FIG. 3*e*).

When the voltage Vcs at the terminals of the capacitive storage element Cs reaches the cutoff threshold S1*b*, the microcontroller 18 is powered off and the data about the binary counts T and M remain in nonvolatile memory 19 as is shown in FIGS. 3*c* and 3*e*.

In the following, the elements specific to the second embodiment shown by FIG. 2 are detailed. According to a second embodiment, microcontroller 18 implements a single binary count, the activation count M. In other words, according to this embodiment, the microcontroller 18 estimates the amplitude of deformations of the sliding board 25. In fact, the time count T is obtained by an oscillator 16 and a counter 17 which here are separate elements from the microcontroller 18.

The oscillator 16 delivers a periodic signal to the counter 17. With each period of the periodic signal from the oscillator 16, the counter 17 increments the time count T. For example, the oscillator 16 can be a quartz oscillator and the counter 17 can be implemented by placing a series of T flip-flops in cascade.

In this second embodiment, the oscillator 16 and the counter 17 are powered by the capacitive storage element Cs by means of a second voltage comparator 22*a*.

This second voltage comparator 22*a*, provided with an external reference Fa and surrounded by resistances R1*a*, R2*a* and Ria, implements the comparator with hysteresis function with which to close, respectively open, the switch 21*a* in order to connect, respectively disconnect, the oscillator 16 and the counter 17 to the capacitive storage element Cs.

To do that, two thresholds are defined S0*h* and S0*b*, respectively called in the remainder of the description counting threshold S0*h* and activation threshold S0*b*. In other words, the analysis system 100, according to this second embodiment, comprises two voltage comparators 22, 22*a*, with a first voltage comparator 22 configured for controlling the power for the microcontroller 18 depending on the supply threshold S1*h* and the cutoff threshold S1*b* and the second voltage comparator 22*a* configured for controlling the supply to the oscillator 16 and the counter 17 depending on the counting threshold S0*h* and the deactivation threshold S0*b*.

In the second embodiment, the thresholds are defined such that:

$$S0b<S0h<S1b<S1h.$$

When the voltage Vcs at the terminals of the capacitive storage element Cs reaches the counting threshold S0*h*, the output of the second voltage comparator 22*a* goes to the high state, allowing the control of the switch 21*a* which, by closing, connects the capacitive storage element Cs to the oscillator 16 and to the counter 17. In FIG. 4*b*, after having reached the counting threshold S0*h*, the voltage Vcs drops slightly in response to powering the oscillator 16 and counter 17. Starting from the counting threshold S0*h*, a counting phase P1*a* begins until the oscillator 16 and counter 17 are powered down.

As the stresses continue, the voltage Vcs at the terminals of the capacitive storage element Cs reach the supply threshold S1*h*, allowing powering of the microcontroller 18 through the first voltage comparator 22, as was previously described.

At the end of the stresses on the sliding board 25, a discharge of the capacitive storage element Cs appears because the piezoelectric elements 11*a*, 11*b* are no longer supplying the capacitive storage element Cs.

Thus, when the voltage Vcs at the terminals of the capacitive storage element Cs goes below the cutoff threshold S1*b*, the output of the first voltage comparator 22 goes back to the low state, allowing the opening of the switch 21 and disconnecting the capacitive storage element Cs from the microcontroller 18. Further, although the microcontroller 18 has been disconnected, the capacitive storage element Cs continues to discharge.

Because of the positive feedback of the resistances R1*a*-R3*a* on the second voltage comparator 22*a*, the deactivation threshold S0*b* is set at a voltage value equal to S0*b*=S0*h*−ΔV4 where ΔV4 represents the hysteresis generated by placing the resistances R1*a* and R3*a* in parallel. Thus, when the voltage Vcs at the terminals of the capacitive storage element Cs goes below the cutoff threshold S0*b*, the output of the second voltage comparator 22*a* goes back to the low state, allowing opening of the switch 21*a* and disconnecting the capacitive storage element Cs from the oscillator 16 and counter 17.

The operating method for the portion 102 relating to the determination of at least one information related to the use of the sliding board 25 is next described according to the second embodiment using FIGS. 4*a*, 4*b*, 4*c*, 4*d* and 4*e*.

Once the oscillator 16 and the counter 17 are powered and the piezoelectric elements 11*a*, 11*b* continue to supply the capacitive storage element Cs with electric energy, the time count T is incremented and then stored in a buffer memory, meaning a temporary memory which clears when power is removed. The buffer memory changes at the frequency of the counter 17. In the same way as before, once the microcontroller 18 is powered (phase P2), the microcontroller 18 is configured to increment the activation count M and write it in the nonvolatile memory 19 once the voltage Vcs reaches the maximum reference value REFmax, as shown in FIG. 4*c*.

This incrementing and also this writing in memory of the activation count M consumes energy represented by a voltage drop ΔV2 in FIG. 4*b*.

When the flexions of the sliding board 25 are interrupted, the piezoelectric elements 11*a*, 11*b* stop supplying electric energy to the capacitive storage element Cs whose voltage Vcs progressively decreases and goes past a minimum reference value REFmin. Once the voltage Vcs reaches this minimum reference value REFmin, the microcontroller 18 is configured to read the time count T written in the buffer memory and write it in nonvolatile memory 19. It should be noted that writing this time count T leads to a voltage drop ΔV3. Further, in order to adapt the voltage levels between the counter 17 and the microcontroller 18, the electronic processing circuit 15 comprises buffers.

In the second embodiment, the thresholds are defined such that:

$$S0b<S0h<S1b<S1h<REFmin<REFmax.$$

During the phases P1*a*, P2 and P3, the electronic processing circuit 15 performs at least one binary count T, M by using the voltage Vcs at the terminals of the capacitive storage element Cs. In the phases P3 and P4, when the activity of the sliding board is stopped, the counting of the stresses M is automatically stopped since the maximum reference REFmax value is no longer reached, whereas the counting of the length of use T by the oscillator 16 and the counter 17 continues. When the voltage Vcs at the terminals of the capacitive storage element Cs reaches the cutoff threshold S1*b*, the microcontroller 18 is powered off and the data about the binary counts T such as the length of use T2 and the number of activations M1 remain in nonvolatile memory 19 as is shown in FIGS. 4*c* and 4*e*.

It should be noted that the length of use T2 is greater than the length of use T1 calculated with the first embodiment, because the counting by the counter 17 started running earlier.

The counting of the length of use T is stopped at the end of phase P1*a*, when the voltage is less than or equal to the deactivation threshold S0*b*. However, powering off the oscillator 16 and the counter 17 has the consequence of resetting the buffer memory to zero, as shown in FIG. 4*d*. Further, as shown by FIG. 4*e*, the storage of the time count T in nonvolatile memory 19 is done at time tREFmin, consequently the length counted after tREFmin is lost.

Implementation variants of the operating method have been identified whether for the first embodiment shown in FIG. 1 or for the second embodiment shown in FIG. 2.

According to a first variant of the operating method, it is possible to provide that the microcontroller 18 is configured to write both the activation count M and the time count T in the nonvolatile memory 19 once the voltage Vcs at the terminals of the capacitive storage element Cs reaches the maximum reference value REFmax. With such a variant, getting away from the minimum reference value REFmin is possible. According to a specific variant, the maximum reference value REFmax is equal to S1*h*, which makes it possible to do away with reference values.

According to a second variant of the operating method, it is possible to provide that the microcontroller 18 is configured to write in alternation the activation count M and then the time count T in the nonvolatile memory 19 once the voltage Vcs at the terminals of the capacitive storage element Cs reaches the maximum reference value REFmax. The alternation is preferably uniform, such as one time out of N, where N is equal to two.

In this case, the activation count M is incremented by the value N each time the maximum reference value REFmax is reached by the voltage Vcs.

According to a third variant of the operating method, in which the nonvolatile memory 19 comprises several data storage cells, it is possible to provide that, once the microcontroller 18 is powered, meaning once the voltage Vcs at the terminals of the capacitive storage element Cs reaches the supply threshold S1*h*, it writes the time count T in a first cell of the nonvolatile memory 19. When the voltage Vcs at the terminals of the capacitive storage element Cs again reaches the supply threshold S1*h*, the microcontroller 18 writes the new time count T in a second cell of the nonvolatile memory 19 and so on, so as to form a stacked memory. The sum of these stacked cells or the last stack cell, according to whether the internal clock 18 or the computer 17 is reset to zero or not with each writing, corresponds to an estimate of the length of use of the sliding board 25. According to this third variant of the operating method, the activation count M is equal to the number of stacked cells. Stacked cell is understood to mean a cell in which data was recorded. The value M1 of the activation count M is then determined at the end of writing, for example during reading data recorded in the nonvolatile memory 19.

In all cases, except the case of the previously described third variant of the operating method, while writing in the nonvolatile memory 19, the microcontroller 18 is configured to:

- read the time count T and the activation count M which were previously recorded in the nonvolatile memory 19, for example during previous recordings corresponding to previous uses of the sliding board;
- update the time count T and the activation count M by incrementing the previously recorded values T and M with values T and M which were just calculated; and
- recording the new time count T and the new activation count M in the nonvolatile memory 19.

In the case of the third variant of the operating method, while writing in nonvolatile memory 19, the microcontroller 18 is configured to:

- identify an empty cell adjacent to a filled cell, or the first empty cell in the case of an initial writing to memory; and
- record the value of the time count T in the cell identified during the preceding step.

Thus, whatever the variant of the operating method chosen, the nonvolatile memory 19 contains the value T, corresponding to the length of use of the sliding board since the first use thereof on snow and also the value M corresponding to the level of stresses of the sliding board since the first use thereof on snow.

It is understood that the time count T contains information related to the deformation time of the surface 12 of the sliding board and therefore information related to the length of use of the sliding board. By making the approximation that the start-up phase P1 of the capacitive storage element is small compared to the phases during which the microcontroller 18 is active, meaning phases P2 and P3, it is possible to compare the time count T to the length of use of the sliding board 25.

Further, the counting of this time count T uses operations or components with low energy consumption, for example power under 5 μW.

The analysis system 100 could solely provide this first parameter corresponding to the time count T. Instead, the invention can also give access to other values besides T depending on the electronic components chosen to form the electronic processing circuit 15.

Also, in particular, the invention proposes to provide a second parameter which is the activation count M. This activation count M aims to represent information related to the amplitude of the deformations of the surface 12. In other words, this information represents the intensity of the activity of the sliding board, or the way in which the sliding board is actually stressed.

More precisely, the operations for reading the previous number and writing the new number in memory by the microcontroller consume significant electrical power.

The activation count M therefore represents the number of times the microcontroller 18 consumed this quantity of energy; it is therefore related to the quantity of energy consumed by the microcontroller 18 in the active mode thereof. By making the approximation that executing the time count T and the start up and shut down phases of the microcontroller 18 have negligible energy consumption compared to the quantity of energy consumed during incrementing of this activation count M, it is possible to relate the activation count M to the quantity of energy stored in the capacitive storage Cs, and of the quantity of energy generated by deformation of the surface 12. Thus, the higher the count M, the more severely the sliding board 25 was stressed.

By taking the ratio of the activation count M to the length of use T, is possible to estimate the power applied by the user.

This power can be either calculated with appropriate electronic elements added to the electronic processing circuit 15, not shown, and then stored in the nonvolatile memory 19, or be calculated after transmission of the time count T and activation count M values to an external reader, not shown.

Measurements done on downhill skis have given very different activation count M values depending on the level of the skier. In fact, for example, an adult user with a good skiing level writes to memory 100 times (meaning an incrementation of the count M equal to 100) in 10 seconds, whereas a beginning child, snowplowing writes to memory only twice (meaning incrementation of the count M equal to 2) in 10 seconds. The activation count M is therefore a good indicator of the ski activity, and therefore the level of the skier. The larger the value of M after a fixed length of use, the greater the activities of the skier and therefore the higher their skiing level, since the sliding board was highly stressed. Finally, making the approximation that the electric power of the electronic processing circuit 15 is consumed mainly by the microcontroller 18 during writing of counts T, M into memory, it is possible to estimate a state of wear of the sliding board, or a level of engagement of a skier by knowing the activation count M and the energy consumed by the microcontroller 18 on each incrementation of the activation count M. It is thus possible to know the real use of the ski and thus to know whether the skier is stressing the ski thereof a little or a lot; with this, a skier can be informed of the energy difference imposed on one ski compared to another, in the case where both skis from the pair of skis are equipped with the analysis system 100. For example, it is possible to know whether a skier is stressing one leg more strongly than the other. Further, it also becomes possible to make payment for the sliding board based on the effective use thereof.

For example, a ski renter could be billed solely for the usage time of the sliding board 25, meaning solely when the user skis. Thus, it is possible to rent the sliding board 25 depending on the effective length of use of the sliding board 25.

After recording values of the time counter T and the activation count M in nonvolatile memory 19, microcontroller 18 or the counter 17 is reset to zero, because of their loss of power. However, it is conceivable, in the case of the second embodiment shown in FIG. 2, to provide that the microcontroller 18 be configured to reset the counter 17 to zero before reaching the cutoff threshold S1*b* or after writing the time count T to memory. An overflow past the maximum value that the counter 17 can contain can be avoided by resetting the microcontroller 18 or computer 17 to zero; this overflow would have the consequence of automatically resetting to zero, which will lead to an error in the calculation of the time count T.

Further, the values of the counts T and M can be extracted from the electronic processing circuit 15 to get information related to the deformation time of the sliding board and therefore to the length of use of the sliding board from the count T and/or information related to the amplitude of the deformations of the sliding board coming from count M. It is also possible to calculate the mechanical power generated by the user and in particular by the skier. In fact, as was previously described, the calculation of the magnitude M/T reflects the mechanical power generated by the user which can be correlated to the level of the skier. Further, the values M and M/T can give information on the actual wear of the sliding board and also the actual activity of the user in connection with their performance and their level.

In order to provide for communication and extraction of values stored in nonvolatile memory 19, the electronic processing circuit 15 comprises a portion 104 relating to communication.

This portion 104 could comprise a wired connector providing data transmission, but, preferably, the electronic processing circuit 15 comprises a radio frequency antenna 20 configured for powering the nonvolatile memory 19 by electromagnetic coupling. In that way, an external reader can get the counts T and M wirelessly. This "RFID" transmission system comprises a passive tag which uses the wave coming from the scanner/reader for powering the nonvolatile memory 19 and thus sending the counts T and M to the scanner/reader.

Preferably, the external reader can also order the microcontroller 18 to reset the count values T and M in the nonvolatile memory 19 to zero.

A ski rental center or skier performance evaluation center could have the external reader in order to centralize the information gathered on each ski, or the reader could be directly accessible to the user by using a smart-phone type device, for example.

Thus, the external reader can extract the counts T and M to get information related to the length of use of the sliding board and/or the amplitude of the deformations of said surface 12 and/or for calculating the mechanical power generated by the user and in particular by the skier.

The integration of such an analysis system in the sliding board 25 is described in the continuation of the description. In the description which follows, the terms relating to "front", "rear", "upper", "lower" are defined relative to the sliding board 25. More precisely these terms are defined relative to a longitudinal axis, transverse axis and vertical axis of the sliding board 25 where the longitudinal axis is the axis along which a maximum length of the sliding board 25 is measured, the vertical axis is orthogonal to the plane of the sliding board 25 and the transverse axis is orthogonal to both the longitudinal and the vertical axes. The terms "front" and "rear" are defined along the longitudinal axis of the sliding board 25, relative to the position of the skier or the binding. The terms "upper" and "lower" are defined along the vertical axis of the sliding board 25, with the lower part being intended to be in contact with the snow, ground or water.

The invention is shown in particular in FIGS. 5 to 13 on a board for skiing which is a downhill ski or touring ski.

Figure 5:
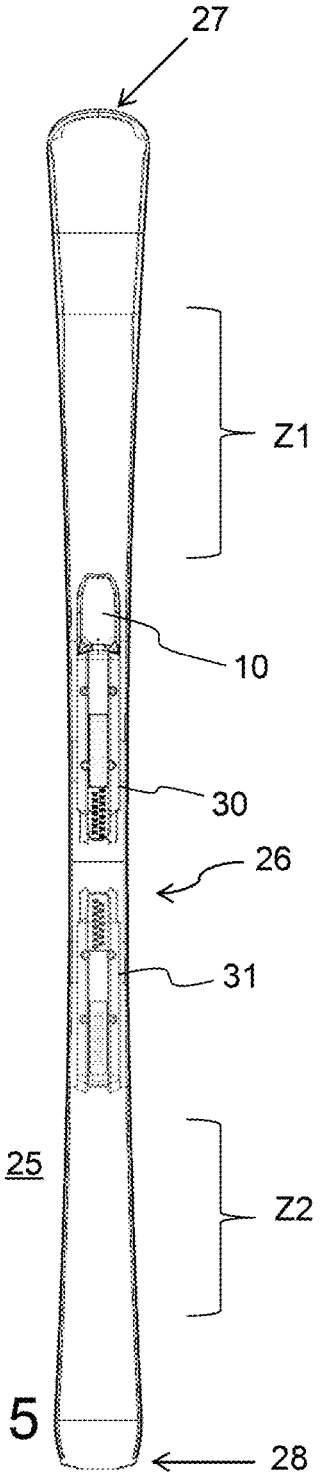
FIG. 5 is a top view of a sliding board conforming to the invention.

FIG. 5 shows a sliding board 25 having a front part 27, a rear part 28 and a central area 26 intended for mounting of the binding, arranged between these two parts 27, 28. The front part 27 refers to the part of the sliding board 25 which is normally positioned in front of the skier and which forms the tip whereas the rear part 28 refers to the part of the sliding board 25 which is normally positioned behind the skier and which forms the heel of the sliding board 25.

The binding elements, not shown, are mounted on an interface element which is made up, in the embodiment shown, of mounting and guiding rails 30 and 31, where the binding elements can slide on these rails for adjustment to the length of the skier's boot. These mounting rails are secured to the upper surface of the sliding board 25. This binding is oriented such that the skier is oriented towards the front part 27 in the direction of descent. In a variant not shown, the interface element can be made up of at least one plate on which the binding elements are attached, where this allows the binding elements to be raised from the upper surface of the sliding board 25.

The sliding board 25 has a profile shape suited for skiing on snow. As a variant, all types of sliding boards 25 can be used without changing the invention.

The binding, not shown, comprises a front stop intended to be positioned in the front rail 30, for attaching the front part of the skier's boot, and a rear heel-piece intended to be positioned in the rear rail 31 for attaching the rear of the skier's boot. This front stop and this rear heel-piece form the elements for binding the boot onto the sliding board.

As a variant, the shape, the type of binding, the type of rails or interface for mounting the binding on the sliding board can also vary without changing the invention.

In the case of the sliding board 25 from FIG. 4, the areas Z1 and Z2 show two areas in which the sliding board 25 experiences a maximum deformation during flexion of the sliding board 25 during use on snow.

These areas Z1 and Z2 are also the areas in which the sliding board 25 experiences high risks of impact. For example, the two skis of a skier can cross in these areas Z1 and Z2.

To recover the mechanical energy linked to the deformation of the sliding board 25, the invention proposes to use at least one piezoelectric element 11*a*-11*b*. In the embodiment shown, these piezoelectric elements 11*a*-11*b* are preferably disposed between the front rail 30 supporting the stop of the binding and the area Z1 experiencing a maximum deformation. In other words, these 30 piezoelectric elements 11*a*-11*b* are positioned very close to the area Z1, in an area where the deformations remain sufficient and where they remain sufficiently protected, in particular from external impacts.

It is nonetheless possible to position the piezoelectric elements 11*a*-11*b* in the areas of maximum deformation Z1 and Z2 without changing the invention. In this case, protective elements could be added, in particular on the lateral sides of the piezoelectric elements 11*a*-11*b*.

Figure 6:
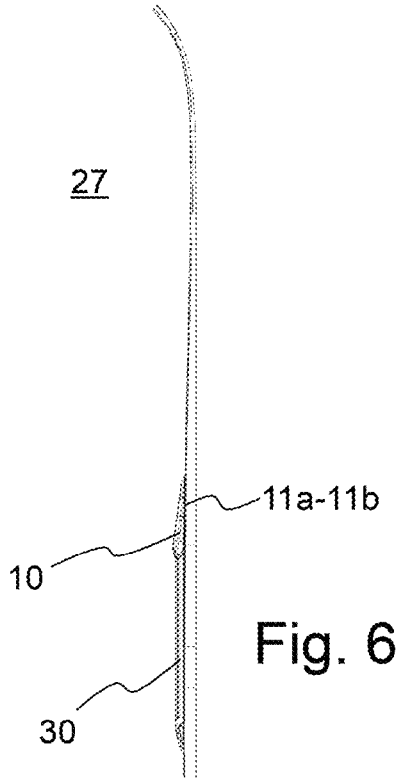
FIG. 6 is a side view of the front part of the sliding board from FIG. 5.
Figure 7:
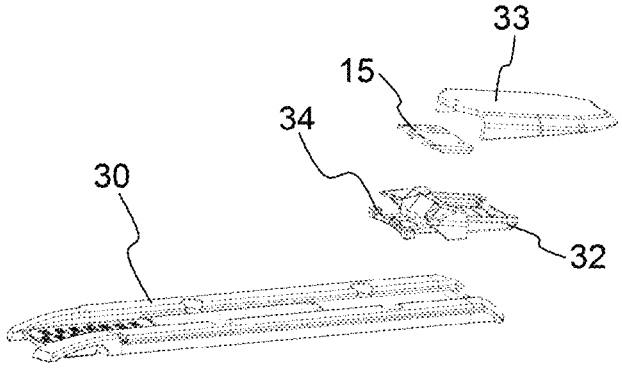
FIG. 7 is an exploded perspective view of the front elements brought onto the sliding board from FIG. 5.
Figure 8:
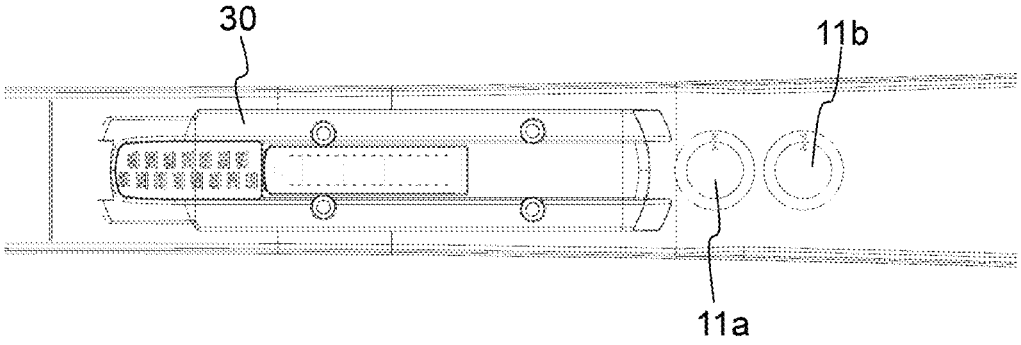
FIGS. 8 to 11 are partial top views of the sliding board from FIG. 5 in several mounting positions of the various elements of the analysis system.

The energy generated by these piezoelectric elements 11*a*-11*b* is transmitted to an electronic processing circuit 15. Preferably, such as shown in FIGS. 5 and 6, this electronic processing circuit 15 is disposed very close to the piezoelectric elements 11*a*-11*b* to make connecting the electric wires between the piezoelectric elements 11*a*-11*b* and the electronic processing circuit 15 easier.

In particular, the electronic processing circuit 15 is mounted in a case positioned above the two piezoelectric elements, at the end of the front mounting rail 30 of the stop for the binding.

In other embodiments, not shown, the electronic case containing the electronic circuit could be mounted in any other position of the sliding board 25, preferably near the mounting area for the bindings 26, at the front or rear of this area, even between the front and rear binding elements for the boot, even inside a plate interposed between the sliding board 25 and the ski binding.

FIGS. 8 to 11 show the mounting of the piezoelectric elements 11*a*-11*b* and the electronic circuit 15 on the sliding board 25. As shown on FIG. 8, the piezoelectric elements 11*a*-11*b* are secured to the sliding board 25 and more specifically onto a surface of an element of the sliding board, where the surface can be internal or external the sliding board. They can be applied by adhering onto one of the layers of the structure of the sliding board 25 after molding the sliding board 25, or be immersed and therefore integrated inside the structure of the sliding board 25 during molding of the sliding board 25.

FIGS. 8 to 11 show the layout of two juxtaposed piezoelectric elements 11*a*-11*b*. As a variant, a single piezoelectric element can be placed. The number of piezoelectric elements 11*a*-11*b* is chosen such that the energy recovery is sufficient to power the associated electronic processing circuit 15.

According to the example shown, each piezoelectric element 11*a*-11*b* comprises an upper circular central part forming the active part of the piezoelectric material, configured for capturing deformations of a surface 12 of the sliding board 25, and a lower circular part disposed below the circular central part and with larger dimensions than it, forming a reference ground.

Of course, other piezoelectric element shapes can be used, like for example quadrilateral shaped piezoelectric elements. Electric energy produced during a deformation of the surface 12 of the sliding board 25 is captured between the upper circular central part and the lower circular part. As a variant, other piezoelectric element 11*a*-11*b* shapes can be used without changing the invention. It should be noted that the electric energy produced by each piezoelectric element 11*a*, 11*b* is proportional to the volume of piezoelectric material that it comprises.

The internal structure of the sliding board 25 is described in the following paragraphs with reference to FIGS. 12 and 13 in order to illustrate the integration of the piezoelectric elements 11*a*-11*b* into the sliding board 25 and in particular for showing on which surface 12 of the sliding board 25 the piezoelectric elements are attached.

The sliding board 25 comprises a lower assembly 37, and an upper assembly 38, separated by a core 39. More specifically, the lower assembly 37 comprises a sliding bottom 40 typically polyethylene based, on which fins of metal edges 41 rest laterally. In the form shown, this lower assembly 37 also includes a reinforcing layer 42.

The sliding board 25 also includes an upper assembly 38 comprising a decorative and protective layer 43 resting on a reinforcing layer 44.

The decorative and protective layer 43 can be made in various ways, and includes on the lower surface thereof printed areas visible from the upper surface of the board, or else transparent areas, serving to make the reinforcing layer 44 visible from the outside. The upper 38 and lower 37 assemblies are mainly separated by the core 39, which is bordered laterally by the sidewalls 45 which protect the core 39 from outside moisture, and which provide the transmission of forces from the upper assembly to the edges 41. In other variants of sliding board structures 25, not shown, the structure might not comprise sidewalls, and be of "shell" type for example, one might even comprise several reinforcing layers, or even might not comprise edges.

Figure 12:
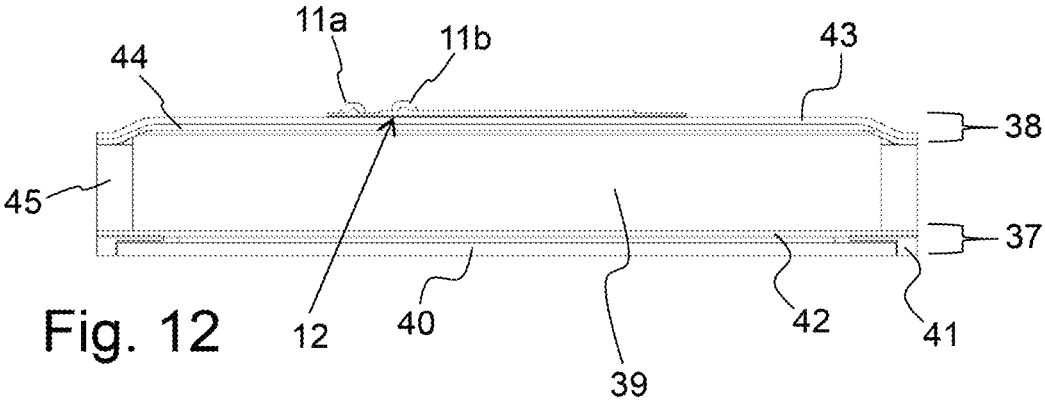
FIG. 12 is a vertical section view of the sliding board from FIG. 5 according to a first embodiment of the invention.

In the first embodiment from FIG. 12, the piezoelectric elements 11*a*-11*b* are attached directly onto the decorative and protective shell 43. Preferably the piezoelectric elements 11*a*-11*b* are attached by adhering onto the decorative and protective layer 43 or onto the support layer. To do this, it is preferable to use a rigid adhesive with a large shearing resistance, for example epoxy, in order to not modify and attenuate the real values of the deformations of the sliding board 25. However, a very thin double-sided type adhesive element creating little shear inside this layer could be considered.

In a variant of this embodiment, a rigid support layer can be attached onto the decorative and protective layer 43 to support the piezoelectric elements 11*a*-11*b*. For example, an aluminum support layer can be used.

Figure 13:
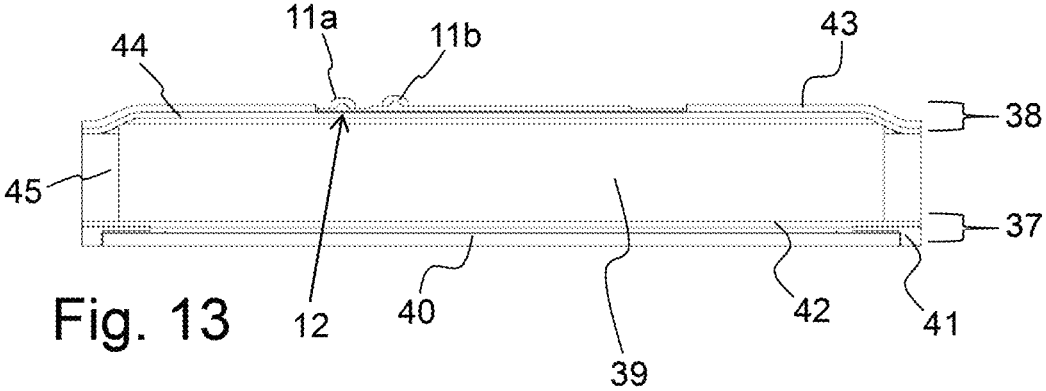
FIG. 13 is a vertical section view of the sliding board from FIG. 5 according to a second embodiment of the invention.

In the second embodiment from FIG. 13, the piezoelectric elements 11*a*-11*b* are attached directly other reinforcing shell 44. To do this, the decorative and protective layer 43 is recessed near the surface 12 for attachment of the piezoelectric elements 11*a*-11*b*, where the piezoelectric elements are then arranged in this recess. As in the first embodiment from FIG. 12, attachment of the piezoelectric elements 11*a*-11*b* with adhesive can be done, either during molding of the sliding board, or after molding of the sliding board.

Figure 9:
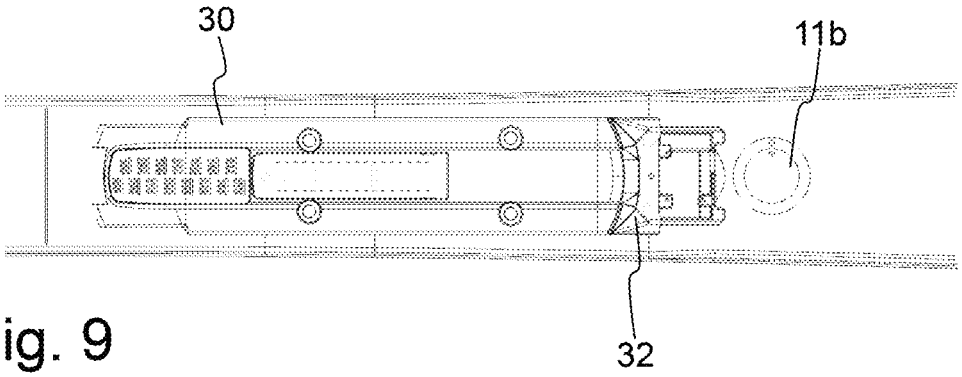

The invention also requires the positioning of the electronic circuit 15 on the sliding board 25. Also, a support 32 is brought onto the sliding board 25 to support the electronic processing circuit 15, such as shown in FIG. 9.

Preferably, this support 32 is removable so as to be able to perform maintenance on the electronic processing circuit 15 by separating the electronic processing circuit 15 from the sliding board 25. This support 32 can be connected by clipping or screwing onto the sliding board 25 or the mounting rail 30 for the binding stop. For example, the support 32 can comprise tabs intended to engage with the holes made in the front part of the mounting rail 30.

This support 32 also defines the position of the electronic processing circuit 15 on the sliding board 25.

In the example from FIGS. 5 to 11, the electronic processing circuit 15 is arranged at the front of the front mounting rail 30 for the binding stop and above the piezoelectric elements 11*a*-11*b*. As a variant, the electronic circuit 15 can be disposed on the piezoelectric elements 11*a*-11*b* without connection to the mounting rail 30 or the front stop of the binding, by being attached the sliding board.

Further, as shown on FIG. 9, the electronic circuit 15 can be screwed onto the support 32, or clipped or even adhered. The electronic processing circuit 15 is next electrically connected to the piezoelectric elements 11*a*-11*b* with wires or suitable connector.

Figure 10:
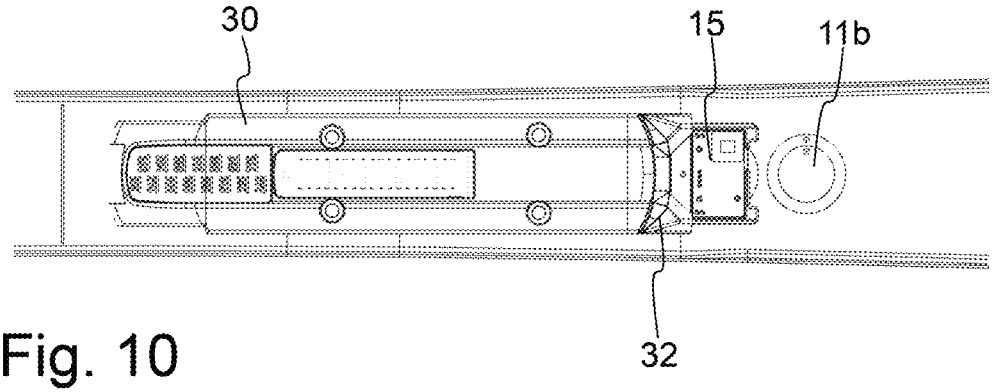
Figure 11:
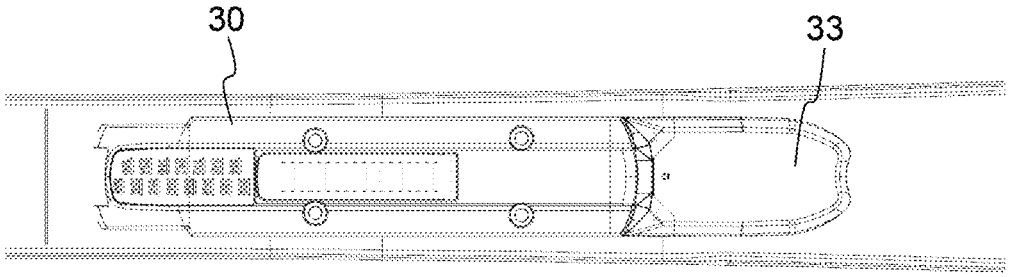

As shown in FIG. 10, a protective cover 33 is mounted on the support 32 so as to protect the electronic processing circuit 15 and the piezoelectric elements 11*a*-11*b*. The protective cover 33 can also be attached by screwing or adhering, for example with the support 32.

Also, the assembly formed by the support 32 and the protective cover 33 forms a case receiving the electronic processing circuit 15 and this case is preferably sealed to protect the electronic components from snow or water; this case is easy to remove from the sliding board.

This protective cover 33 preferably has an aerodynamic shape for limiting the drag of the wind on the sliding board 25 and limit the risk of impact to the electronic processing circuit 15 of the piezoelectric elements 11*a*-11*b*.

In the example shown, the analysis system is composed of a case containing the electronic processing elements brought onto the sliding board and of piezoelectric elements independent of the case bound to the sliding board and connected to the electronics.

In another embodiment not shown, the analysis system could be composed of a single case which would contain the electronic processing elements and which would have under the lower surface thereof a layer including the piezoelectric elements connected to the electronics. This assembly would then be secured to one of the surfaces of the sliding board.

In the case of a sliding board 25 which is a cross-country ski, the location of the piezoelectric elements and the electronic processing case can be similar to that proposed for downhill skis, or it can be advantageous to position the piezoelectric elements farther forward from the front stop of the binding by several centimeters, or even several tens of centimeters to get larger amplitude deformations. This analysis system will be entirely usable in the case of a cross-country ski because of the very low weight thereof, of order 10 to 50 g, from the components of the analysis system.

In the case of a sliding board 25 which is a snowboard supporting both feet of the user, the sliding board 25 would be provided with two distinct bindings. The piezoelectric elements and also the electronic processing case could be positioned on the lateral side of either of the bindings, on the side of the ends of the board, or could be positioned between the two bindings, in a relatively protected area.

This invention combining piezoelectric elements 11*a*-11*b* and an electronic processing circuit 15 has the advantage of storing data T, representing the real-time use of the sliding board 25, and M representing the intensity of the use of the sliding board 25, where these data come from the sliding board 25 during stressing of the sliding board 25.

The start-up of the analysis is automatic once the sliding board 25 is moving and the user does not need to be concerned about either starting up the system, the power source thereof, or electric recharging of the system, since the electronic processing circuit 15 is autonomous because it is directly powered by the piezoelectric sensors 11*a*-11*b*. The user can next access the data T, M recorded in the memory 19 installed on the sliding board 25, and do so later, when the sliding board 25 is no longer in use.

Thus, the invention makes use of at least one piezoelectric element 11*a*-11*b*:

which is both generator of electric energy for the processing circuit 15; and which is also a sensor for measurement of the deformations of the sliding board in the way that the voltage Vpa, Vpb delivered by the at least one piezoelectric element 11*a*-11*b* is used by the electronic processing circuit 15 which is configured for estimating representative values of the use of the sliding board, such as a usage time and/or a level of amplitude of the deformations of the sliding board based on the delivered voltages Vpa, Vpb.

The invention claimed is:

1. A system for analysis of use of a sliding board comprising:

at least one piezoelectric element configured to be secured to said sliding board and generate electric energy during deformations of said sliding board; and an electronic processing circuit configured for estimating at least one parameter of use of said sliding board and configured to be connected to said sliding board;

wherein said electronic processing circuit is powered by said electric energy generated by said at least one piezoelectric element;

wherein said electronic processing circuit comprises:

a nonvolatile memory configured to store at least one information regarding the use of said sliding board; and at least one capacitive storage element for storing at least a portion of said electric energy generated by said at least one piezoelectric element;

wherein said electronic processing circuit comprises a management member configured for incrementing at least one binary count when the voltage at the terminals of said capacitive storage element reaches a threshold value or a maximum reference value such that said at least one binary count represents the length of use of the sliding board and/or an image of the mechanical energy imposed on the sliding board.

2. The analysis system according to claim 1, wherein the estimation of the at least one usage parameter of said sliding board done by said electronic processing circuit is determined depending on said electrical energy generated by said at least one piezoelectric element.

3. The analysis system according to claim 1, wherein said nonvolatile memory is connected to said management member, where said management member is configured for writing said at least one binary count into said nonvolatile memory.

4. A method for analysis of the use of a sliding board implemented by the system such as defined according to claim 3, wherein depending on the voltage at the terminals of said capacitive storage element, said management member is configured for writing said time count and/or said activation count in the nonvolatile memory.

5. The analysis system according to claim 1, wherein said management member comprises an internal clock, where said management member is configured for incrementing a time count for each period of said internal clock as soon as the management member is powered.

6. The analysis system according to claim 1, wherein said electronic circuit comprises:

an oscillator configured to produce a periodic signal; and a counter connected to said oscillator, configured to increment said at least one binary count representing the length of use of the sliding board, referred to as time count, at each period of the periodic signal produced by said oscillator;

where said time count is accessible to the management member.

7. The analysis system according to claim 1, wherein said electronic processing circuit comprises at least one comparator with hysteresis configured for comparing the voltage at the terminals of said capacitive storage element with at least two threshold values.

8. A sliding board comprising a system for analysis of use of said sliding board according to claim 1.

9. The sliding board according to claim 8, wherein said sliding board comprises binding elements mounted between a front end and a rear end of said sliding board, where said at least one piezoelectric element is arranged between said binding elements and said front end of said sliding board.

10. The sliding board according to claim 8, wherein said sliding board comprises several structural layers:

a lower assembly comprising at least one bottom configured to come into contact with a sliding surface and at least one reinforcing layer;

an upper assembly comprising at least one reinforcing layer; and a core interposed between the upper and lower assemblies;

where said at least one piezoelectric element is disposed in contact with at least one reinforcing layer.

11. The sliding board according to claim 10, wherein said upper assembly comprises a protective and/or decorative layer, said sliding board comprises an opening in said protective and decorative layer in which said at least one piezoelectric element is positioned.

12. The sliding board according to claim 8, wherein said sliding board comprises a protective and/or decorative layer, where said at least one piezoelectric element is disposed in contact with said protective and/or decorative layer.

13. The sliding board according to claim 8, wherein said electronic circuit is mounted on said sliding board in a protective case.

14. The sliding board according to claim 13, wherein said protective case is mounted removably on said sliding board.

15. The sliding board according to claim 13, wherein said sliding board comprises at least one interface element between the upper surface of the sliding board and the binding elements, where said protective case is attached to said at least one interface element.

16. The analysis system according to claim 1, wherein the electronic processing circuit is configured to estimate the time of deformation of said sliding board.

17. The analysis system according to claim 1, wherein the electronic processing circuit is configured to estimate the power experienced by said sliding board.

* * * * *